United States Patent [19]

Jimenez

[11] 4,069,761

[45] Jan. 24, 1978

[54] VEHICLE FLARE ASSEMBLY AND LAUNCHER

[76] Inventor: Fernando Jimenez, 649 Jackson Ave., Elizabeth, N.J. 07201

[21] Appl. No.: 756,285

[22] Filed: Jan. 3, 1977

[51] Int. Cl.[2] ..... F42B 4/26

[52] U.S. Cl. ..... 102/37.4; 102/37.6; 102/37.8; 116/DIG. 40

[58] Field of Search ..... 102/35.6, 37.4, 37.6, 102/37.8; 116/DIG. 40

[56] References Cited

U.S. PATENT DOCUMENTS

| | | | |
|---|---|---|---|
| 2,049,407 | 7/1936 | Clark | 102/37.8 |
| 2,620,763 | 12/1952 | Smith et al. | 102/37.8 |
| 2,751,582 | 6/1956 | Kuykendall | 102/37.4 |
| 3,224,232 | 12/1965 | Dzvonik | 116/DIG. 40 |
| 3,294,056 | 12/1966 | Gouger | 102/35.6 |
| 3,319,596 | 5/1967 | Walter | 102/37.4 |
| 3,752,082 | 8/1973 | Kernan | 102/37.6 |

*Primary Examiner*—Verlin R. Pendegrass

[57] ABSTRACT

A flare assembly including a flare mounted in a base and a plurality of wire legs pivotably connected to the base has its legs folded and the entire assembly inserted in a cup-shaped pusher element in a launch tube mounted beneath a vehicle. A spring under compression, when released by a trigger mechanism actuated from the vehicle dash, will force the pusher element through the tube to catapult the flare assembly into a roadway. The flare has a flint wheel in frictional engagement with the interior of the launch tube so when the flare assembly is launched, the wheel will ignite the flare. The flare will catapult from the vehicle and land on the legs which open to support the flare in an upright position, to warn oncoming vehicles of the distressed vehicle.

7 Claims, 4 Drawing Figures

VEHICLE FLARE ASSEMBLY AND LAUNCHER

BACKGROUND OF THE INVENTION

This invention relates to a distress signal device, and more particularly, a flare assembly which can be launched from the interior of a disabled vehicle without the operator leaving the vehicle.

Most highway safety experts urge that the drivers of all vehicles keep a supply of safety flares in their vehicles so that in the event of a stalled vehicle or other emergency, one or more flares may be ignited and placed on the roadway to give warning to oncoming motorists. Heretofore, it has been the customary practice for the driver to stop his vehicle, take a flare from the trunk or other part of the vehicle where the flare is stored, strike the flare igniter, and then place the ignited flare in the appropriate position on the road. This type of procedure is not only time consuming, but normally requires the person placing the flare to leave his vehicle and expose himself to the danger of being struck by some moving vehicle.

SUMMARY OF THE INVENTION

In accordance with the present invention, a device is provided which can be operated by the driver of a vehicle to discharge a signaling flare from the rear of the vehicle so that the flare will come to rest at some distance at the rear of the vehicle. Simultaneously with the discharge of the flare its ignition is effected, the vehicle operator having nothing to do but close an actuating circuit. The ignited flare is catapulted from a launch tube provided beneath the vehicle and lands in an upright position on legs pivotably provided on the flare assembly.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
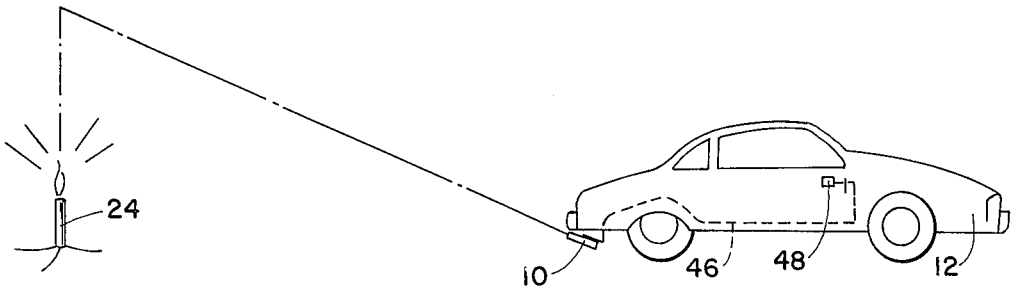
FIG. 1 is a schematic diagram illustrating the mounting of the flare assembly of the present invention on a motor vehicle, and the manner in which it can be launched from a motor vehicle.

Referring now to the drawing in detail, wherein like numerals indicate like elements throughout the several views, a launch tube 10 is mounted beneath the rear of the chassis of a motor vehicle 12 at a convenient location by means of a U-shaped mounting bracket 14 receiving fasteners 16 through opposed flanges 18 on bracket 14. The bracket 14 mounts launch tube 10 at an angle to the horizontal road surface.

Figure 2:
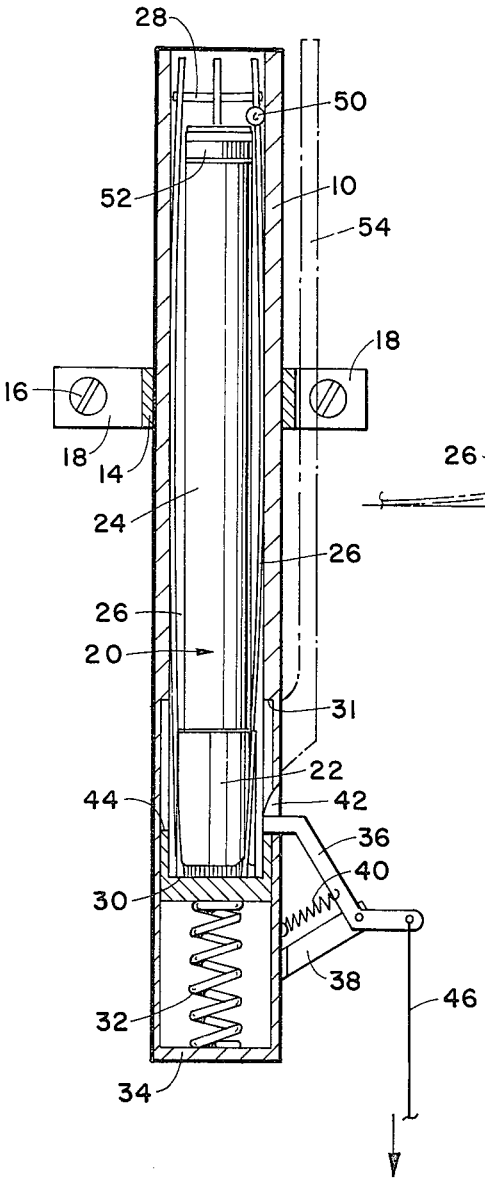
FIG. 2 is a longitudinal cross-sectional view of the flare assembly in a launch tube.
Figure 3:
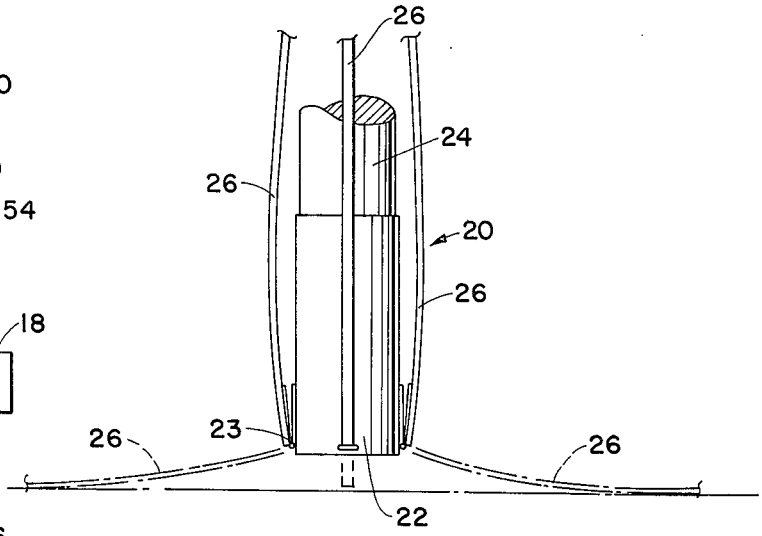
FIG. 3 is a partial side view in elevation of the flare assembly.
Figure 4:
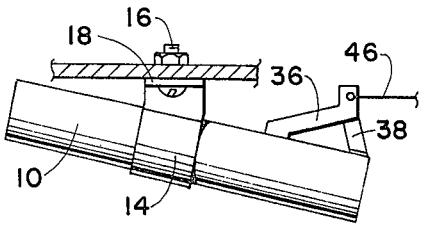
FIG. 4 is a side view in elevation of the launch tube.

A flare assembly 20 is housed within launch tube 10 and includes a tubular base 22 receiving a flare 24. Pivotably connected to base 22 by hinges 23 are a plurality of spring wire legs 26. Legs 26 are normally pivoted to a closed position, as shown in full lines in FIGS. 2 and 3, and held in closed position relative to flare 24 by a rubber band 28 disposed thereabout, adjacent the ends of the legs. The flare assembly 20, in folded condition, is inserted horizontally in launch tube 10, as shown in FIG. 2.

When inserted in launch tube 10, base 22 is received in abutment with a cup-shaped pusher element 30 slidable for a limited distance within tube 10 until it abuts an annular shoulder 31 under the urging of a compressed coil spring 32 between the pusher element 30 and a closed end 34 of launch tube 10. A release trigger 36, pivotably mounted on a support 38 fixed to the exterior of launch tube 10 is held by a coil spring 40, under tension, in an arcuate slot 42 extending through tube 10 in contact with the annular top edge 44 of pusher-element 30. A cable 46 connects trigger 36 to a pull lever 48 on the dash of vehicle 12.

Upon pulling lever 48 and cable 46, trigger 36 is pivoted out of slot 42, allowing coil spring 32 to expand to thrust pusher element 30 forwardly to catapult flare assembly 20 from launch tube 10, as shown by the arrows in FIG. 1. A flint wheel 50 is mounted by a ring 52 on the top of flare 24 in frictional engagement with the interior surface of launch tube 10. Accordingly, when flare assembly 20 is launched, flint wheel 50 will frictionally generate sparks to ignite flare 24 so when launched, it will be ignited. The lit flare 24 will burn through rubber band 28, releasing legs 26, so that after launch and ignition of flare 24 the flare 24 will land in an upright position on legs 26 as shown by the phantom lines in FIG. 3, as a warning to oncoming motorists.

To reload a new flare assembly 20 in launch tube 10, the flare assembly 20 is provided with a new flare 24 in base 22 and the legs 26 folded and held together by a rubber band 28 and inserted in tube 10. The assembly 20 can be pushed against the bias of coil spring 34 until pusher element 30 is locked in place by trigger 36 or a slidable push rod 54 (shown in phantom lines in FIG. 2) may be inserted through a slot in the exterior wall of tube 10 for frictional contact with base 22 to aid in sliding base 22 and flare assembly 20 into tube 10. A complete refill flare assembly 20 including legs, flare, etc., may be pre-packaged for insertion into the launch tube.

While a specific embodiment of a vehicle flare assembly and launcher has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A pyrotechnic signal device comprising:

a flare assembly including a base, a flare inserted in said base, a plurality of legs pivotably mounted on said base, and a tube for launching said flare assembly from a vehicle including means on said tube for mounting said tube on a vehicle, a cup-shaped pusher element slidably mounted in said tube receiving the base of said flare assembly, compressed spring means between said pusher element and tube for sliding said pusher element in said tube to catapult said flare assembly onto a roadway, stop means in said tube for limiting the amount of sliding movement of said pusher element, trigger release means extending through said tube adapted to overly said pusher element, said trigger release means being actuated from within the interior of a vehicle, and flare ignition means on said flare in frictional engagement with the interior of said tube for igniting said flare as said flare is catapulted and launched from said tube by said pusher element.

2. The device of claim 1 wherein said flare ignition means includes a flint wheel mounted on said flare.

3. The device of claim 1 including means retaining said legs locked to each other, said means including a rubber band.

4. The device of claim 1 wherein said stop means includes an annular shoulder undercut in the interior wall of said tube in the path of movement of said pusher element.

5. The device of claim 1 wherein said trigger release means includes a link pivotably mounted on a support on the exterior of said tube, a cable connected to one end of said link, and the other end of said link extending through an arcuate slot in the side wall of said tube to overly the top edge of said pusher element.

6. The device of claim 1 wherein said mounting means includes a U-shaped bracket on the exterior of said tube having oppositely extending flanges receiving fasteners therethrough.

7. The device of claim 1 wherein said legs include spring wire elements hinged to said base.

* * * * *